US006612867B1

(12) United States Patent
Wu

(10) Patent No.: US 6,612,867 B1
(45) Date of Patent: Sep. 2, 2003

(54) STACKED CONNECTOR ASSEMBLY

(75) Inventor: Jerry Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/122,099

(22) Filed: Apr. 12, 2002

(51) Int. Cl.[7] ..... H01R 13/60
(52) U.S. Cl. ..... 439/541.5
(58) Field of Search ..... 439/541.5, 79

(56) References Cited

U.S. PATENT DOCUMENTS 5,030,115 A 7/1991 Regnier et al.
5,336,109 A 8/1994 Hillbish et al.
5,466,171 A * 11/1995 Bixler et al. ..... 439/378
5,800,207 A * 9/1998 Hsu et al. ..... 439/541.5
5,823,822 A 10/1998 Tan et al.
5,839,922 A 11/1998 Orleando et al.
5,851,125 A * 12/1998 Hsu et al. ..... 439/541.5
5,888,103 A 3/1999 Norizuki et al.
5,934,944 A 8/1999 Aoyama et al.
6,146,194 A 11/2000 Loc
6,159,040 A * 12/2000 Chang et al. ..... 439/541.5
6,179,651 B1 * 1/2001 Huang ..... 439/541.5
6,183,270 B1 * 2/2001 Huang et al. ..... 439/541.5
6,296,530 B1 10/2001 Yoneda et al.
6,354,875 B1 3/2002 Wu

OTHER PUBLICATIONS

U.S. patent application Ser. No. 10/122,099, Wu.

* cited by examiner

*Primary Examiner*—Gary Paumen
(74) *Attorney, Agent, or Firm*—Wei Te Chung

(57) ABSTRACT

A stacked connector assembly (10) includes a first connector (12) and a second connector (14) vertically stacked on the first connector. The first connector includes a first housing (16) having a top face (44) on which axially aligned pairs of opposing sockets (48) are formed. The second connector includes a second housing (52) having a bottom face (54) on which axially aligned spindles are formed. The second housing is positioned on the first housing with opposite ends of each spindle rotatably received in and supported by the corresponding pair of sockets to hingedly connect the second connector to the first connector.

23 Claims, 6 Drawing Sheets

STACKED CONNECTOR ASSEMBLY

FIELD OF THE INVENTION

The present invention generally relates to a stacked connector assembly, and more particular to connectors hinged together to form a stacked connector assembly.

THE RELATED ARTS

An electrical connector pair for mating each other to connect a first circuit board, such as a circuit board of a computer disk drive, to a second circuit board, such as a main circuit board of a docking station, are known in the field of connectors, such as SCA-2 based connectors. Such electrical connectors are thus often referred to as "board-to-board"connectors. Connectors of similar function for connecting two circuit boards are also available in the market, such as EBBI connectors (EBBI is a registered mark of Molex Inc., Lisle, Ill.). Each pair of the board-to-board connectors comprises a plug (or male) connector and a socket (or female) connector releasably mating each other. An example is disclosed in U.S. Pat. No. 5,466,171.

To save the occupied area of the printed circuit board on which connectors are mounted, the connectors can be assembled in a stacked relation before mounting to the printed circuit board. The stacked connectors, which is generally called "stacked connector assembly" are also well known in the field of connectors. Examples are shown in U.S. Pat. Nos. 5,800,207 and 5,851,125. These stacked connector assemblies each require a bracket to secure connectors together. The brackets increase the costs of the assemblies. Furthermore, the connectors in these assemblies are secured together by means of mortise-tenon and/or snap fitting structures. However, such a securing means is not convenient to operate; thus, the assembling efficiency is low. Accordingly, an improved stacked connector assembly is necessary to overcome the disadvantages of the prior art.

SUMMARY OF THE INVENTION

Accordingly, an object of the present invention is to provide a stacked connector assembly which does not need a bracket to secure connectors of the assembly together.

Another object of the present invention is to provide a stacked connector assembly wherein connectors of the assembly can be easily secured together.

To achieve the above objects, in accordance with the present invention, a stacked connector assembly comprises a first connector, such as an SCA-2 based receptacle connector, and a second connector, such as an EBBI based plug connector, and vertically stacked on the first connector. The first connector comprises a first housing having a top face on which axially aligned pairs of opposing sockets are formed and a plurality of terminals each having a tail. The second connector comprises a second housing having a bottom face on which axially aligned spindles are formed and a plurality of terminals each having a tail. The second housing is positioned on the first housing with opposite ends of each spindle rotatably received in and supported by a corresponding pair of sockets to hingedly connect the second connector to the first connector. Each housing comprises two arms extending rearward from opposite ends thereof. Each arm of the second housing is stacked on the corresponding arm of the first housing. A spacer has a high profile portion having a plurality of openings therein and a low profile portion having a plurality of openings therein. The high profile portion is retained between the rearward-extending arms of the second connector with the tails of the second terminals extending through the corresponding openings. The low profile portion is retained between the rearward-extending arms of the first housing with the tails of the first terminals extending through the corresponding openings.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
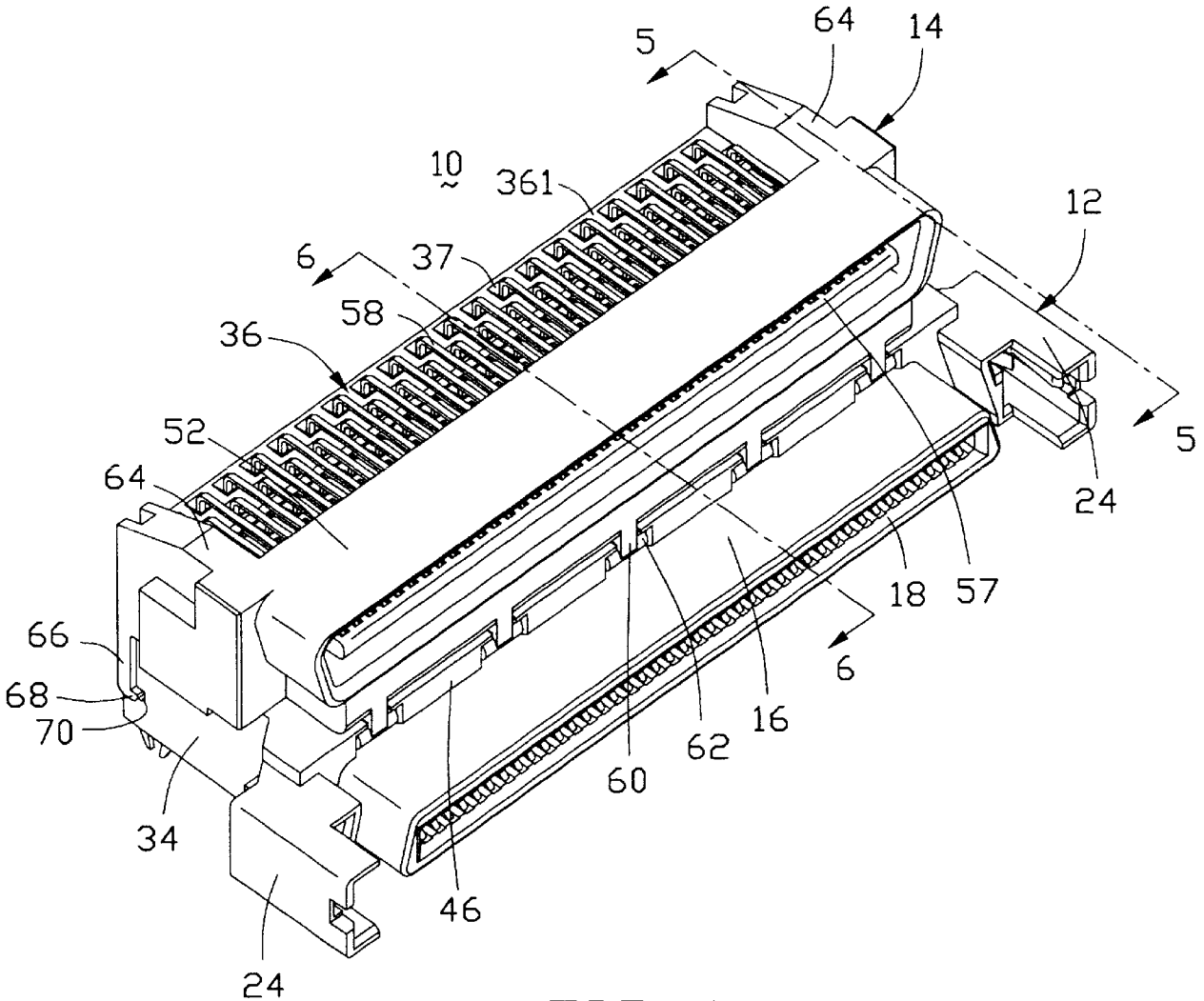
FIG. 1 is a front, top perspective view of a stacked connector assembly in accordance with the present invention.
Figure 2:
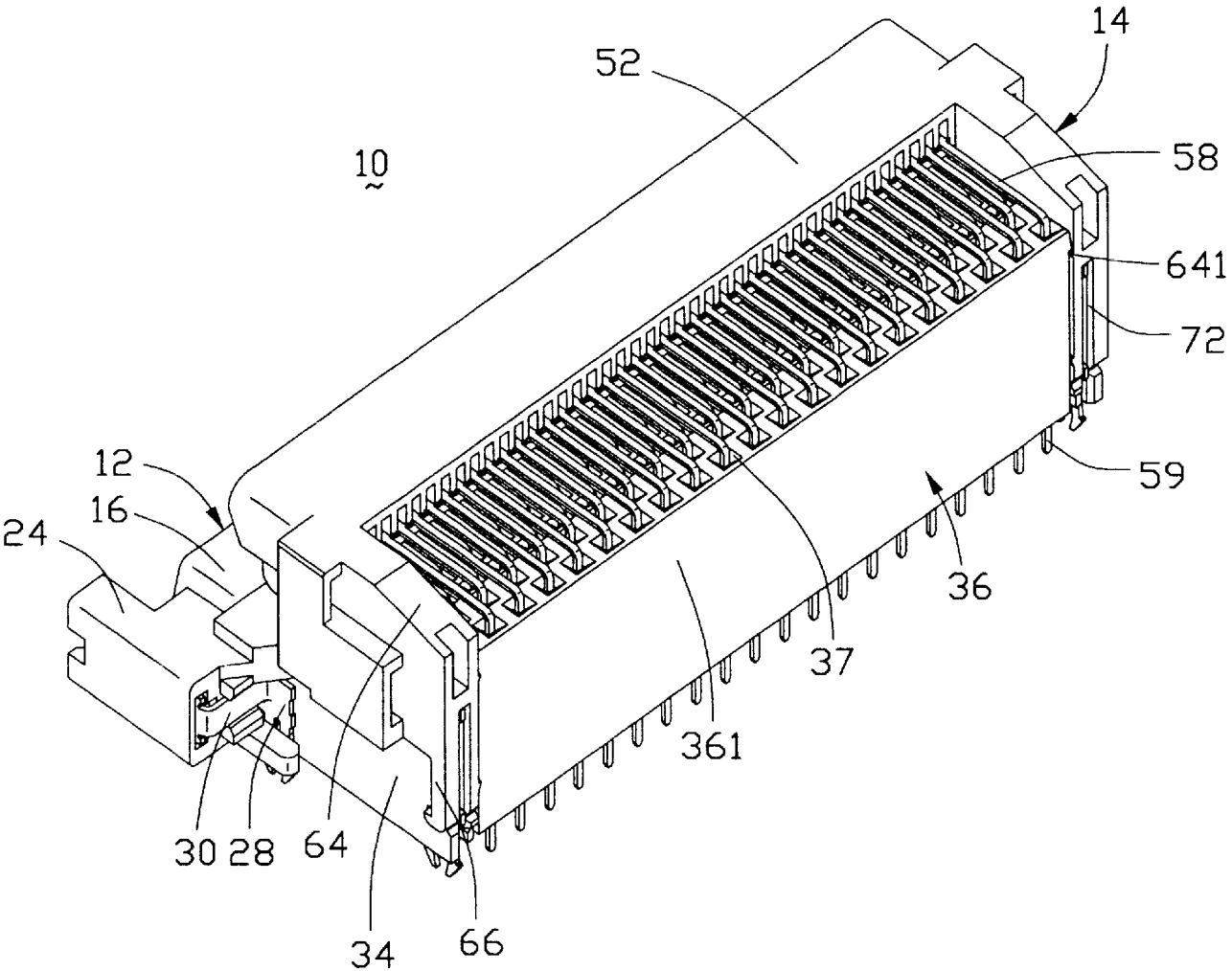
FIG. 2 is view similar to FIG. 1, from a rear aspect.
Figure 3:
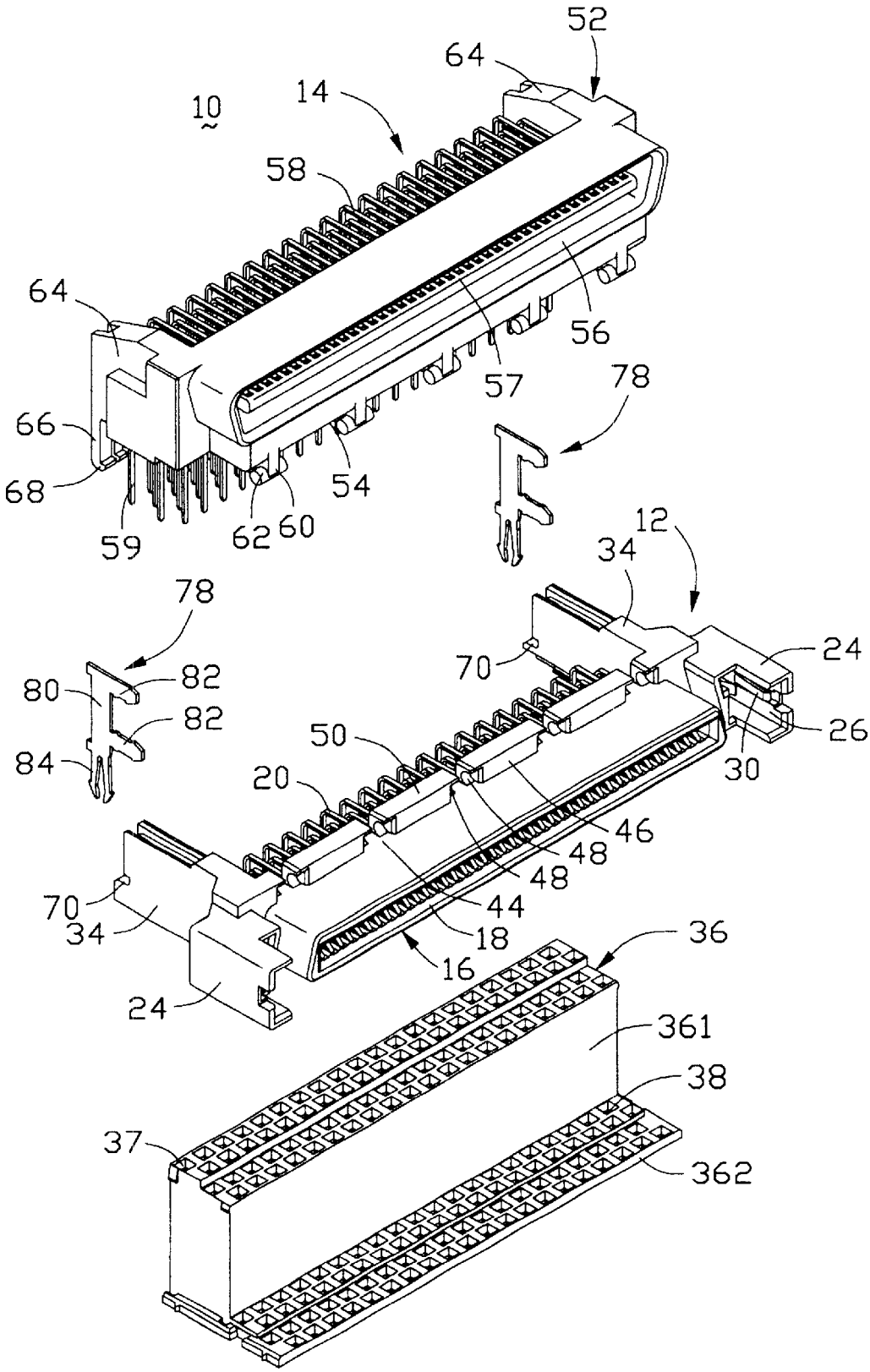
FIG. 3 is an exploded view of FIG. 1.
Figure 4:
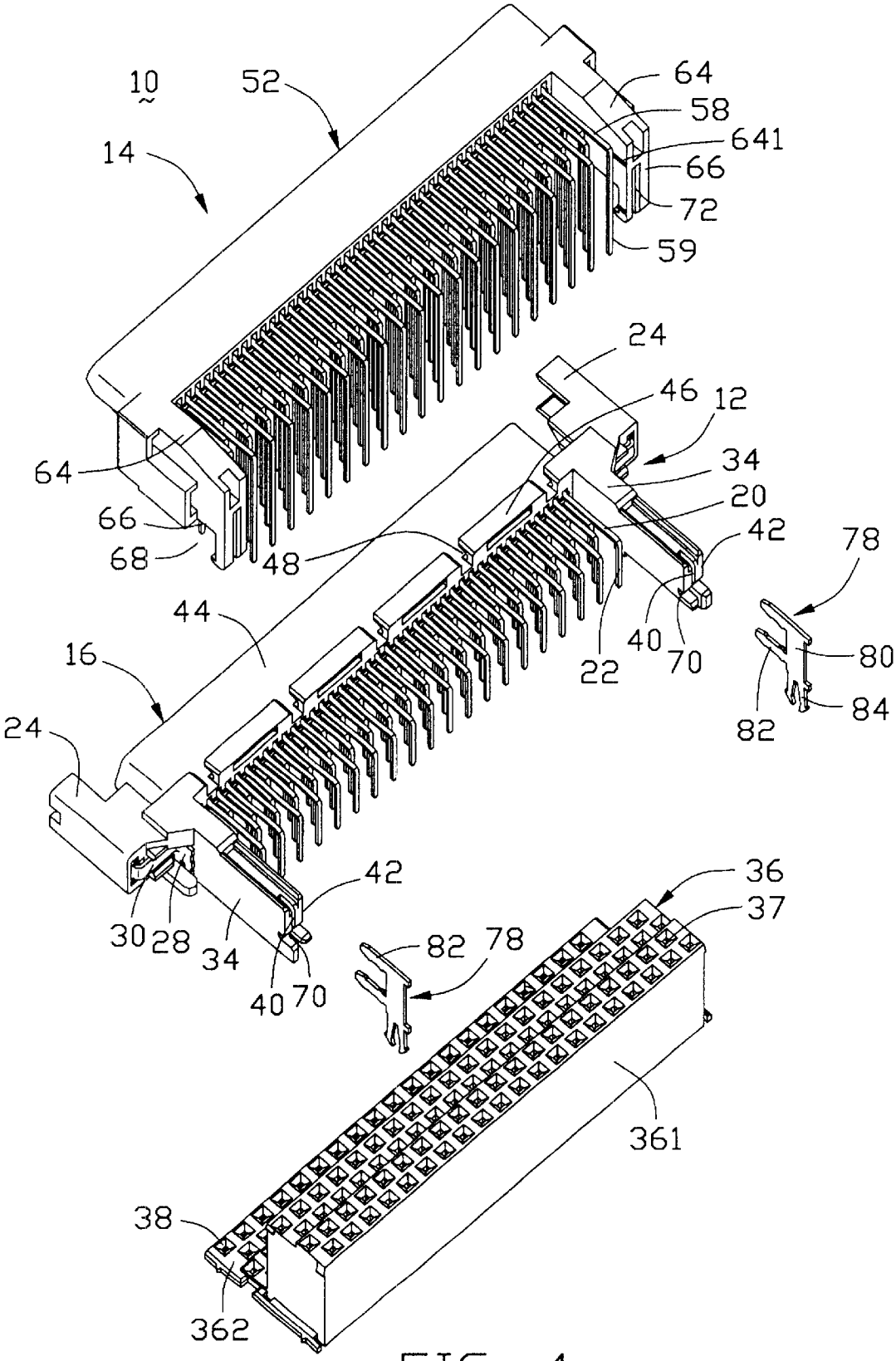
FIG. 4 is an exploded view of FIG. 2.

With reference to the drawings and particularly to FIGS. 1–4, a stacked connector assembly constructed in accordance with the present invention, generally designated with reference numeral 10, comprises a first (lower) connector 12, such as an SCA-2 based receptacle connector, a second (upper) connector 14, such as an EBBI based plug connector, vertically stacked on the first connector 12 and a spacer 36 for equidistantly spacing outside longer tails 59 and inside shorter tails 22 of terminals 58, 20 of the connectors 14, 12, and preventing the tails from buckling when they are inserted into a printed circuit board (not shown).

Figure 6:
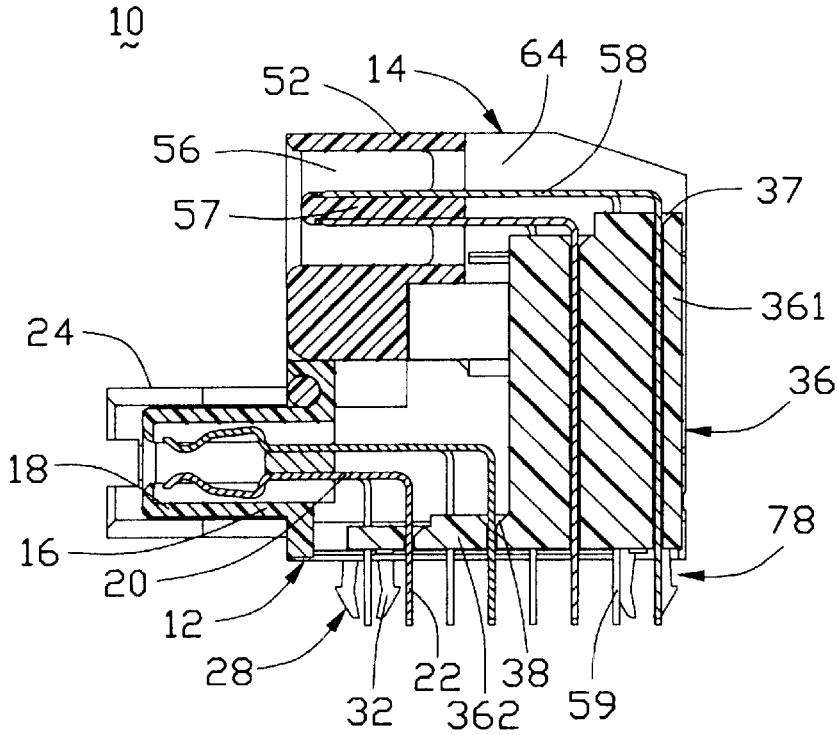
FIG. 6 is a cross-sectional view taken along line 6—6 of FIG. 1.

Also referring to FIG. 6, the first connector 12 comprises a first elongate housing 16 having a front mating face (not labeled) for matingly engaging a first mating connector. A surrounding wall 18 having opposite portions (not labeled) is formed on and extends from the front mating face of the first housing 16. First conductive terminals 20 are retained in the first housing and arranged along inner surfaces of the opposite portions of the surrounding wall 18 for electrically engaging with the first mating connector. Each first terminal 20 has a tail 22 extending beyond a bottom surface (not labeled) of the first housing 16 for insertion into the printed circuit board.

The first housing 16 has two forward-extending arms 24 extending from opposite ends thereof in a forward direction. The surrounding wall 18 is located between the forward-extending arms 24. Each forward-extending arm 24 forms a guide channel 26 for guidingly receiving a complementary guidepost of the first mating connector. A first board lock 28, made of conductive materials, is attached to each end of the first housing 16 and has an extension 30 extending into a corresponding guide channel 26 for electrically engaging a corresponding grounding member of the first mating connector to ground the first mating connector. The first board lock 28 has two spaced, resilient, barbed legs 32 for interferentially fitting into a corresponding hole defined in the printed circuit board to thereby retain the stacked connector assembly 10 to the printed circuit board.

The first housing 16 also has two rearward-extending arms 34 extending from the ends thereof. A space (not labeled) is defined between the rearward-extending arms 34 for accommodating the tails 22 of the first terminals 20. In the embodiment illustrated, a spacer 36 in the form of a step has a high profile portion 361 having a plurality of openings 37 therein and a low profile portion 362 having a plurality of openings 38 therein. The high profile portion 361 is retained between the rearward-extending arms 64 of the second connector 14 with the tails 59 of the second terminals 58 extending through the corresponding openings 37. The low profile portion 362 is retained between the rearward-extending arms 34 of the first housing 16 with the tails 22 of the first termninals 20 extending through the corresponding openings 38.

Each rearward-extending arm 64 of the second connector 14 forms a pair of elongated protrusions 641 for having an interferential engagement with the high profile portion 361 of the spacer 36 to enhance the stability of the stacked connector assembly 10. Each rearward-extending arm 34 defines a first, vertically-extending slit 40 in a rear end face 42 thereof. The use of the slits 40 will be discussed later.

The first housing 16 has a top face 44 on which a lengthwise-extending rib comprising a number of spaced but aligned segments 46 is formed. Each segment 46 has opposite ends each forming a socket 48 with a front face of the segment 46. Each segment 46 has a flat top surface 50.

The second connector 14 comprises an elongate second housing 52 positionable above the first housing 16 of the first connector 12. The second housing 52 has a length substantially corresponding to that of the first housing 16 of the first connector 12 and a bottom face 54 resting on the flat top surface 50 of the segments 46 of the first housing 16. The second housing 52 also has a front mating face in which a cavity 56 is defined for receivingly and engagingly mating a second mating connector (not shown). A tongue plate 57 is arranged in the cavity 56 and retains second terminals 58 made of conductive material for electrically engaging the second mating connector.

The second housing 52 forms a number of projections 60 on the bottom face 54 thereof. Each projection 60 is received in a space (not labeled) between two adjacent segments 46. Each projection 60 has two oppositely laterally extending pivots 62. The pivots 62 are rotatably fitted in corresponding sockets 48 whereby the second connector 14 is rotatably mounted to the first connector 12 about the pivots 62. The rotatable connection allows relative movement of the second housing 52 with respect to the first housing 16 whereby the second housing 52 is positioned on the flat top surface 50 of the segments 46 of the first housing 16.

The second housing 52 has rearward-extending arms 64 extending from opposite ends thereof in a rearward direction and corresponding in position to and resting on the rearward-extending arms 34 of the first housing 16. A latch 66 depends from each rearward-extending arm 64 and forms a catch 68 received in and engaging with a notch 70 defined in the rear end face 42 of the corresponding rearward-extending arm 34 of the first housing 16 thereby securing the first and second connectors 12, 14 together. A slit 72 is defined through each latch 66. After assembly of the connector assembly 10, the slits 72 are aligned with the slits 40 in the arms 34 of the first connector 12.

Figure 5:
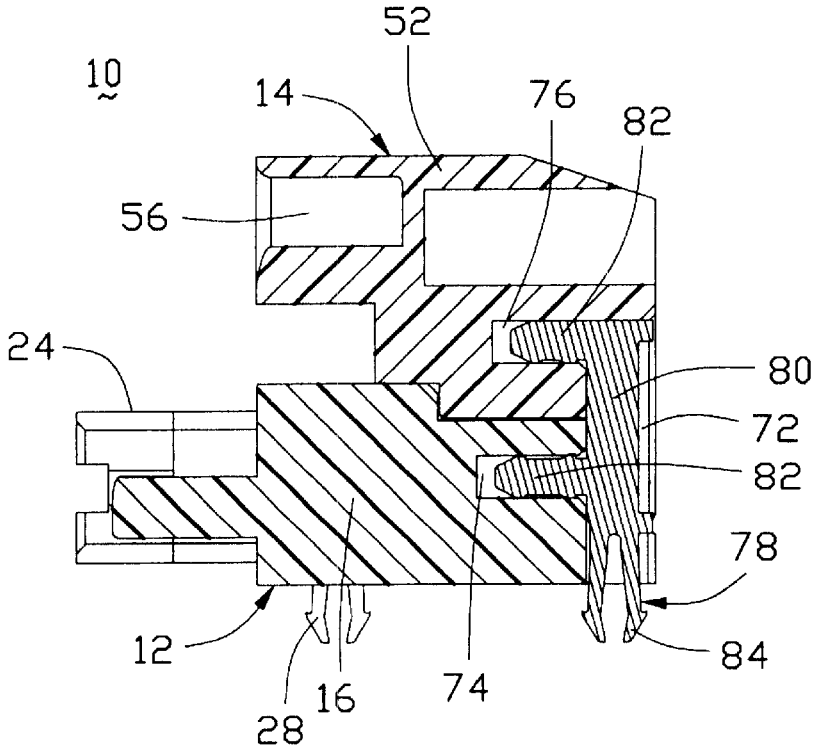
FIG. 5 is a cross-sectional view taken along line 5—5 of FIG.

Also referring to FIG. 5, each rear-extending arm 34 of the first housing 16 defines a first channel 74 in communication with the vertically-extending slit 40 and extending in a forward direction along the arm 34. Each rear-extending arm 64 of the second housing 52 defines a second channel 76 in communication with the slit 72. A second board lock 78 comprises a vertically-extending base section 80 received in the slit 72 of each latch 66 of the second housing 52 and partially fit into the vertically-extending slit 40 of the first housing 16. The second board lock 78 comprises two barbed beams 82 extending forwardly from the base section 80 and interferentially fit into the first and second channels 74, 76 of the rearward-extending arms 34, 64 of the first and second housing 16, 52 to securely fix the second connector 14 to the first connector 12 after the first and second connectors 12, 14 are assembled together.

The second board lock 78 has two spaced, resilient, barbed legs 84 depending from the base section 80 for interferentially engaging with a hole defined in the printed circuit board to retain the stacked connector assembly 10 on the circuit board.

Figure 7:
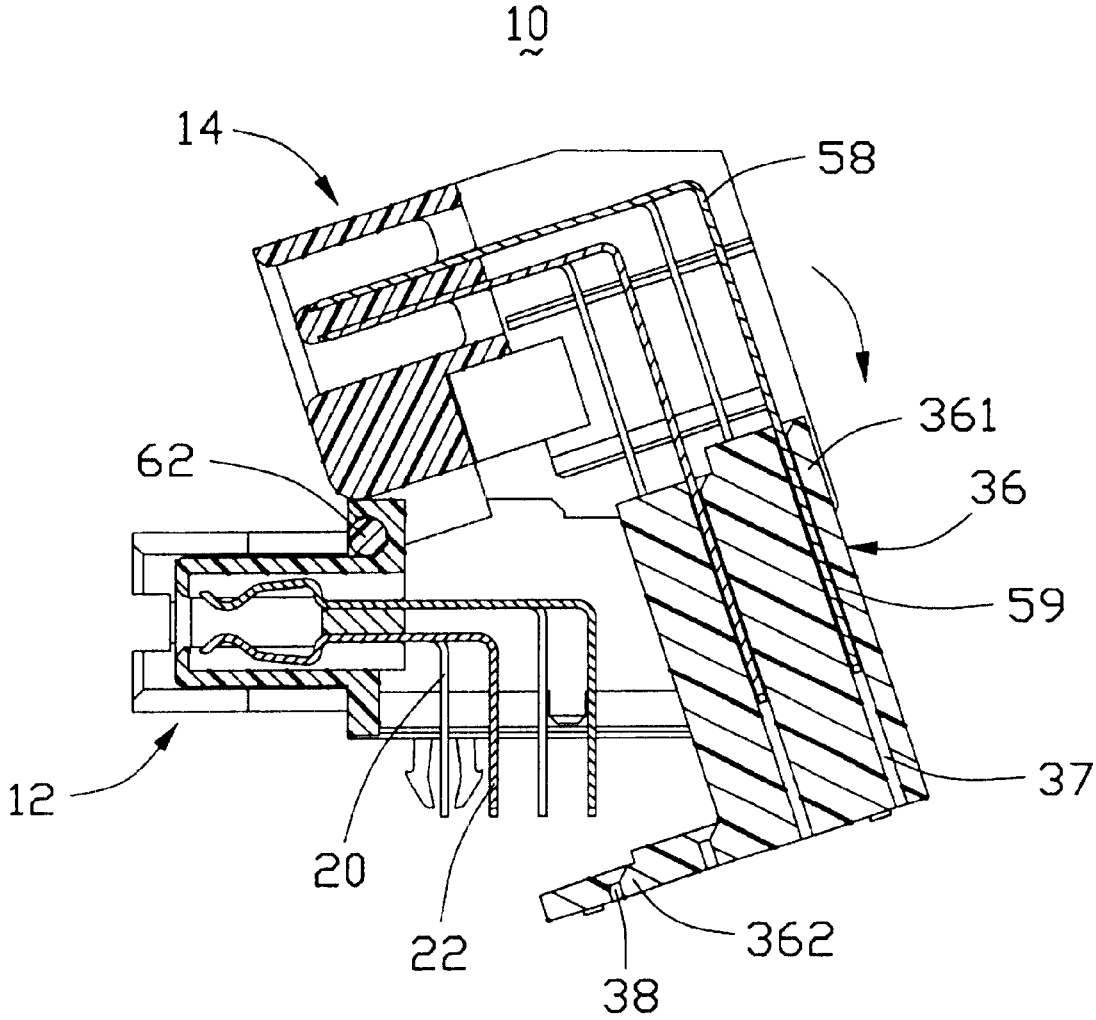
FIG. 7 is a cross-sectional view showing a step in assembling the connector assembly in accordance with the present invention.

Referring to FIG. 7, in assembling the first and second connectors 12, 14, to form the connector assembly 10, the pivots 62 are firstly fitted into the sockets 48 so that the second connector 14 is pivotably mounted on the first connector 12. The second connector 14 is oriented to be inclined relative to the first connector 12. The tails 59 of the terminals 58 of the second connector 14 are partly inserted into the openings 37 of the high profile portion 361 of the spacer 36 is rotated clockwise to a position in which the bottom face 54 of the second connector rests on the top flat surface 50 of the segments 46 and the openings 38 of the low profile portion 362 of the spacer 36 are aligned with the tails 22 of the terminals 20 of the first connector 12. Thereafter, the spacer 36 is moved upwardly until it is appropriately engaged between the protrusions 641 of the rear-extending arms 64 of the second connector 14. Finally, the board locks 78 are assembled to the first and second connectors 12, 14 to securely fasten the two connectors together.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A stacked connector assembly comprising:

a first connector comprising a first housing receiving a plurality of first terminals therein, each first terminal having a tail, the first housing having a top face on which a first portion of a hinge means is formed;

a second connector comprising a second housing receiving a plurality of second terminals therein, each second terminal having a tail, the second housing having a bottom face on which a second portion of the hinge means is formed;

the second housing is stacked on the first housing with the bottom face of the second connector positioned on the top face of the first connector, the second portion of the hinge means being rotatably coupled to the first portion of the hinge means to hingedly connect the second connector to the first connector; and a spacer having a first high profile portion receiving outside longer tails of the second terminals therein, and a second low profile portion receiving inside shorter tails of the first terminals therein.

2. The stacked connector assembly as claimed in claim 1, wherein the first portion of the hinge means comprises a pair of opposing sockets and the second portion of the hinge means comprises a pivot pin having opposite ends rotatably received in the sockets.

3. The stacked connector assembly as claimed in claim 2, wherein the first portion of the hinge means comprises a plurality of axially aligned rib segments formed on the top face of the first housing, a space being defined between opposing ends of adjacent segments and each of the opposing ends of the rib segments forming a socket, and wherein the second portion of the hinge means comprises a projection extending from the bottom face of the second housing and received in each space between the rib segments of the first housing, a pivot pin being retained by each projection and having opposite ends rotatably received in the sockets formed in the opposing ends of the rib segments.

4. The stacked connector assembly as claimed in claim 1, wherein the connector assembly further comprises latching means between the first and second housings to securely fix the second housing to the first housing.

5. The stacked connector assembly as claimed in claim 4, wherein the latching means comprises latches depending from the second housing, each latch having a catch engaging with a notch defined in the first housing.

6. The stacked connector assembly as claimed in claim 5, wherein the latching means comprises a locking member that comprises a base section from which two beams extend, each beams being received in a channel defined in each of the first and second housings thereby fixing the first and second housings together.

7. The stacked connector assembly as claimed in claim 6, wherein the beams comprise barbs for interferentially engaging the corresponding channels of the first and second housings.

8. The stacked connector assembly as claimed in claim 6, wherein spaced, resilient legs depend from the base section for interferentially engaging a hole defined in a circuit board.

9. The stacked connector assembly as claimed in claim 1, wherein the first housing has a bottom surface adapted to be positioned on a circuit board, board locks being attached to the first housing and having legs extending beyond the bottom surface adapted for being interferentially fitting into holes defined in the printed circuit board to retain the stacked connector assembly on the circuit board.

10. The stacked connector assembly as claimed in claim 1, wherein the first housing has opposite ends from which two arms respectively extend in a forward direction, each arm defining a guide channel adapted to guidingly receive a guide post of the first mating connector.

11. The stacked connector assembly as claimed in claim 10, wherein the first connector comprises a board lock attached to the first housing and comprising a grounding member extending into the guide channel for grounding the first mating connector.

12. The stacked connector assembly as claimed in claim 1, wherein the first housing has opposite ends from which two first arms respectively extend in a rearward direction, each first arm having a rear end face defining a notch and wherein the second housing has opposite ends from which two second arms respectively extend in a rearward direction, a latch depending from each second arm and forming a catch engaging the notch to securely fix the second housing to the first housing.

13. The stacked connector assembly as claimed in claim 12, wherein the first arms correspond in position to the second arms with the latches of the second arms overlapping the rear end faces of the first arms, a first slit being defined through each latch, a second slit being defined in the rear end face of the corresponding first arm and in registration with the first slit, a first channel defined in each first arm and in communication with the second slit, a second channel defined in each second arm and in communication with the first slit, a locking member comprising a base section received in the first and second slits and first and second barbed beams extending from the base section and interferentially fit into the first and second channels to securely fix the first and second housings together.

14. The stacked connector assembly as claimed in claim 13, wherein the first housing is adapted to be positioned on a circuit board with the first and second terminals electrically connected to the printed circuit board and wherein the locking member comprises spaced, resilient legs depending from the base section for interferentially engaging a hole defined in the printed circuit board for retaining the stacked connector assembly on the circuit board.

15. The stacked connector assembly as claimed in claim 14 further comprising additional board locks attached to the first housing and adapted to engage with the printed circuit board to facilitate retaining the stacked connector assembly on the circuit board.

16. A method for assembling a stacked connector assembly, comprising the steps:

providing a first connector having a plurality of first terminals therein with a first tail of the first terminal extending beyond the first connector;

providing a first portion of hinge means on the first connector;

providing a second connector having a plurality of second terminals therein with a second tail of the second terminal extending beyond the second connector;

providing a second portion of hinge means on the second connector;

positioning the second portion of hinge means of the second connector to the first portion of hinge means of the first connector;

providing a spacer with a rear portion having a plurality of openings therein and a front portion having a plurality of openings therein;

assembling the second tails of the second terminals to the openings of the rear portion of the spacer when said second connector is located at an angled position relative to the first connector;

rotating the second connector with the spacer to a horizontal position in which the openings of the front portion of the spacer are aligned with the first tails of the first terminals of the first connector; and fixing the first tails of the first terminals to the openings of the front portion of the spacer.

17. The method as claimed in claim 16 further comprising a step of moving the spacer upwardly until the spacer is engaged a plurality of rear-extending arms of the second connector.

18. The method as claimed in claim 16 further comprising a step of assembling a plurality of board locks to the first and second connectors to securely fasten the two connectors together.

19. The method as claimed in claim 16, wherein in the spacer said rear portion is higher than the front portion.

20. A stacked connector assembly comprising:

a first connector including a first housing with a first mating portion and a plurality of first terminals therein;

a second connector stacked upon the first connector and including a second housing with a second mating port and a plurality of second terminals therein; and hinge means for pivotally mounted the second connector onto the first connector; wherein said hinge means including a first portion formed around a front bottom edge of the second housing so as to allow the second housing to be rotatable rearwardly until the first mating port and the second mating portion both face forwardly.

21. The assembly as claimed in claim 20, wherein said hinge means further includes a second portion formed on a top face of the first housing and around a rear portion of the first mating port, said second portion being pivotally engaged with the first portion.

22. The assembly as claimed in claim 20, further including a fastening device with two spaced retention beams respectively horizontally latchably engaged with the first and second housings so as to prevent backward/forward rotation of the second housing relative to the first housing.

23. The assembly as claimed in claim 22, wherein said fastening device is assembled to the first and second connectors forwardly when said first and second housings are completely stacked together, and further includes a board lock mounting leg extending downwardly beyond a bottom face of the first housing.

* * * * *